US008176758B2

(12) United States Patent
Ramsauer et al.

(10) Patent No.: US 8,176,758 B2
(45) Date of Patent: May 15, 2012

(54) PIVOTING LEVER WHICH CAN BE LOCKED IN A HOLLOW AND HAS A COVERING FOR THE LOCKING MEANS

(75) Inventors: Dieter Ramsauer, Schwelm (DE); Sebastian Koch, Wuppertal (DE); Andreas Langenberg, Schwelm (DE)

(73) Assignee: Dirak Dieter Ramsauer Kontruktionselemente GmbH, Ennepetal (DE)

( * ) Notice: Subject to any disclaimer, the term of this patent is extended or adjusted under 35 U.S.C. 154(b) by 36 days.

(21) Appl. No.: 12/678,569

(22) PCT Filed: Aug. 27, 2008

(86) PCT No.: PCT/EP2008/006998

§ 371 (c)(1), (2), (4) Date: Jun. 3, 2010

(87) PCT Pub. No.: WO2009/039933

PCT Pub. Date: Apr. 2, 2009

(65) Prior Publication Data

US 2010/0236303 A1 Sep. 23, 2010

(30) Foreign Application Priority Data

Sep. 19, 2007 (DE) ..... 20 2007 013 103 U

(51) Int. Cl.

| | |
|---|---|
| ***E05B 47/00*** | (2006.01) |
| ***E05B 65/00*** | (2006.01) |
| ***E05B 17/14*** | (2006.01) |

(52) U.S. Cl. ..... 70/208; 70/423; 70/427; 70/455; 70/209

(58) Field of Classification Search ..... 70/208–210, 70/215, 221, 224, 279.1, 278.7, 423–428, 70/455

See application file for complete search history.

(56) References Cited

U.S. PATENT DOCUMENTS

| | | | | |
|---|---|---|---|---|
| 4,631,937 | A * | 12/1986 | Debus et al. | 70/207 |
| 4,898,408 | A * | 2/1990 | Hauber | 292/7 |
| 2006/0201215 | A1 * | 9/2006 | Wolf | 70/423 |
| 2009/0007610 | A1 * | 1/2009 | Hoffmann | 70/192 |
| 2011/0016933 | A1 * | 1/2011 | Ramsauer et al. | 70/277 |

FOREIGN PATENT DOCUMENTS

| | | | |
|---|---|---|---|
| DE | 90 12 372 | | 1/1992 |
| DE | 9012372 | U1 * | 1/1992 |
| DE | 199 07 101 | | 8/2000 |
| DE | 200 06 373 | | 8/2001 |
| DE | 202 11 508 | | 10/2002 |
| EP | 0 453 626 | | 10/1991 |
| EP | 453626 | A2 * | 10/1991 |
| EP | 1 063 370 | | 12/2000 |

* cited by examiner

*Primary Examiner* — Lloyd Gall
*Assistant Examiner* — Ifeolu Adeboyejo
(74) *Attorney, Agent, or Firm* — Frommer Lawrence & Haug LLP

(57) ABSTRACT

A swivel lever can be locked in a trough in a swiveled in position and comprises a locking device which is accommodated in the swivel lever and which can be unlocked by way of an access opening in the swivel lever. The access opening can be made inaccessible by means of a cover. According to the invention, the cover can be blocked mechanically, particularly electromechanically, in its covering position.

11 Claims, 12 Drawing Sheets

PIVOTING LEVER WHICH CAN BE LOCKED IN A HOLLOW AND HAS A COVERING FOR THE LOCKING MEANS

The present application claims priority from PCT Patent Application No. PCT/EP2008/006998 filed on Aug. 27, 2008, which claims priority from German Patent Application No. 10 2007 013 103.8 filed on Sep. 19, 2007, the disclosure of which is incorporated herein by reference in its entirety.

BACKGROUND OF THE INVENTION

1. Field of the Invention

The invention is directed to a swivel lever which can be locked in a trough in a swiveled in position and which comprises a locking device which is accommodated in the swivel lever and which can be unlocked by way of an access opening in the swivel lever, which access opening can be made inaccessible by means of a cover.

2. Description of Related Art

A swivel lever of the type mentioned above is already known, for example, from DE 10 2004 013 369 A1. Reference is had in particular to FIGS. 5A to 5C. It has turned out that the installed locking cylinder is frequently damaged as a result of vandalism, e.g., by spraying in an instant glue or tampering with the cylinder in some other manner.

SUMMARY OF THE INVENTION

Therefore, it is the object of the invention to prevent unauthorized persons from moving the cover for the locking device, such as a profile cylinder, out of its covering position.

The above-stated object is met in that the cover can be blocked mechanically, particularly electromechanically, in its covering position.

Access to the swivel lever lock is at least made more difficult in that the cover can be blocked in its covering position either mechanically or electromechanically.

This reduces the risk of interference with the opening device by unauthorized persons or due to vandalism.

According to a further development of the invention, the cover can be swiveled out of the covering position around an axis extending perpendicular to the extension of the lever. This arrangement is known, per se, from various references. However, the cover cannot be blocked in these arrangements, although devices may be provided which hold the cover in a frictional position or snap in position that defeats unwanted opening.

The cover could also be slid out of the covering position around an axis extending parallel to the lever extension. A solution of this kind is found in the prior art (see component part 132 in FIGS. 5A, 5B and 5C).

It would also be possible to arrange the cover so that it can be folded away around an axis extending perpendicular to the lever extension and parallel to the fastening plane of the closure.

According to a further development of the invention, the cover can be blocked by means of a displaceably supported pin or slide. Alternatively, the cover can be blocked by means of a swivelably supported lever.

The cover can be moved against spring force out of the blocking position or (alternatively) out of the releasing position, which facilitates handling.

Accordingly, the cover can be blocked by means of a lock which is actuated by a lifting magnet or solenoid. Alternatively, the cover may be blocked by means of a motor-actuated lock.

In a particularly advantageous construction of the lockable swivel lever, the cover, together with its shaft extending perpendicular to the lever extension, is displaceable along the longitudinal extension of the lever from a first position (holding position) to a second position (releasing position), the cover being held at its end remote of its shaft by the swivel lever in the holding position.

A further development is characterized in that the swivel lever has a bore hole in the form of an elongated hole for the shaft of the cover such that the cover can be displaced between the holding position and releasing position.

Additional security is provided according to another further development in which the elongated hole has a keyhole shape formed by a circular area for the shaft of the cover in the releasing position and by an adjoining area which narrows in direction of the free end of the swivel lever for the shaft of the cover in the holding position, wherein the cross section of the shaft of the cover deviates from the circular shape at the level of the elongated hole and forms two flattened portions which are parallel to one another and which allow the shaft to be inserted, but not rotated, in the narrowed area of the elongated hole when the cover is oriented to the swivel lever.

According to another embodiment form, the cover is provided for a lock which can be actuated by inserting a key.

On the other hand, the cover can be provided for a profile (half-)cylinder.

The electromechanical drive (e.g., solenoid or motor) can also be provided in a lock case of a bar lock. However, it is also possible to arrange the electromechanical drive in the area of the swivel lever lock.

The electromechanical drive (e.g., solenoid or motor) can also be arranged in the lock case of a bar lock.

It is advantageous when the electromechanical drive can be controlled by a sensor device such as a keypad, a sensing device for biological features (fingerprint, iris, voice, or the like), a code card with magnetic strips, or a chip, or the like.

It is advantageous when the electromechanical drive is part of a monitoring network.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
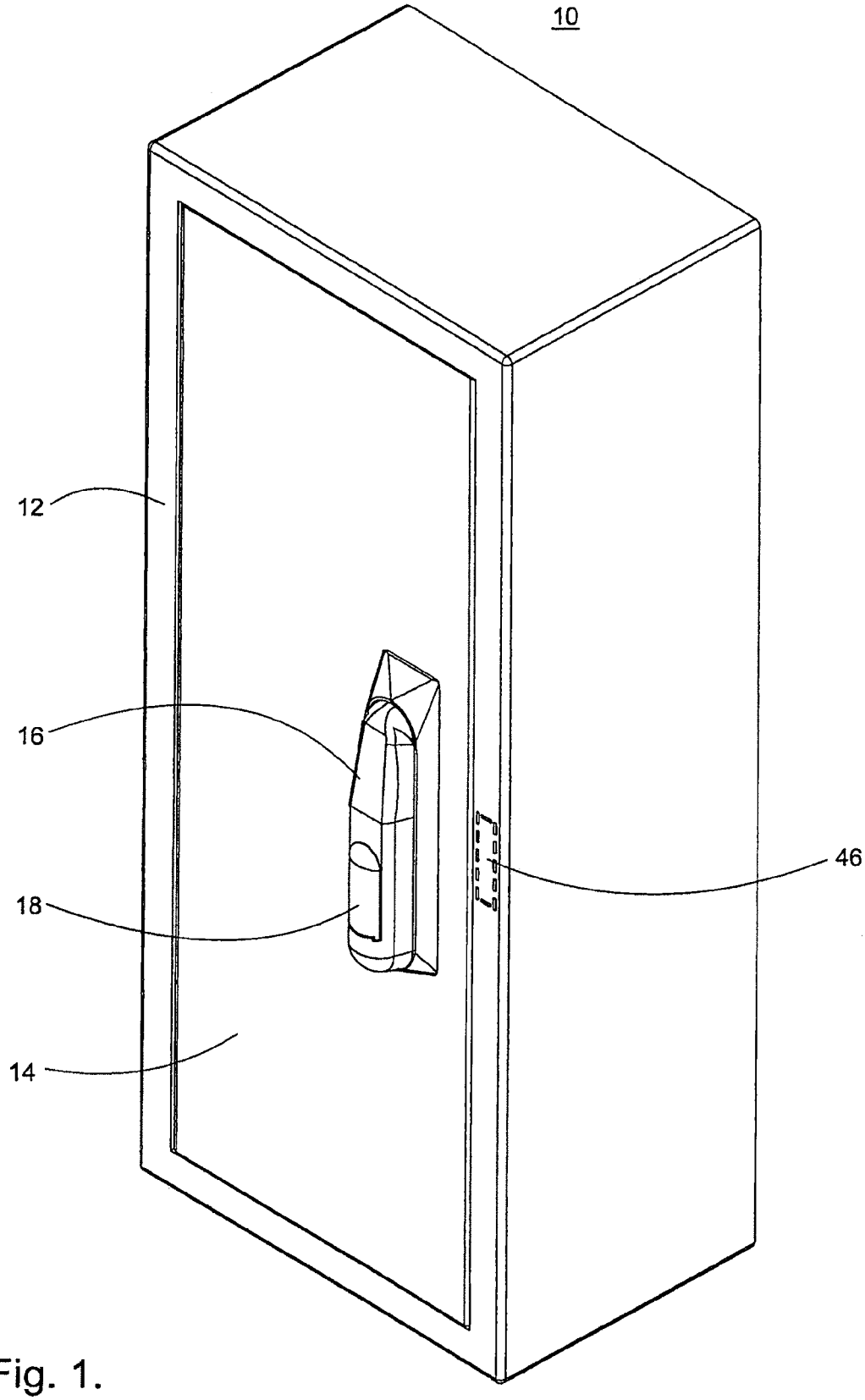
FIG. 1 a switch cabinet with a swivel lever device constructed according to the invention.

FIG. 1 shows a switch cabinet 10 comprising a frame 12, a door 14 and a swivel lever 16. A swivel lever actuating device 16 is shown on the door leaf 14. This swivel lever actuating device 16 can be locked in the position in which it is swiveled into the trough in a manner which is not shown in more detail. The opening for access to the lock is closed by a cover 18.

The back of the door leaf 14 (see FIG. 2) shows that the swivel lever drive 16 shown in FIG. 1 communicates with the lock case 20 for pushing the locking bars 22, 24 in and out in order to open or close the locks, not shown.

Figure 2:
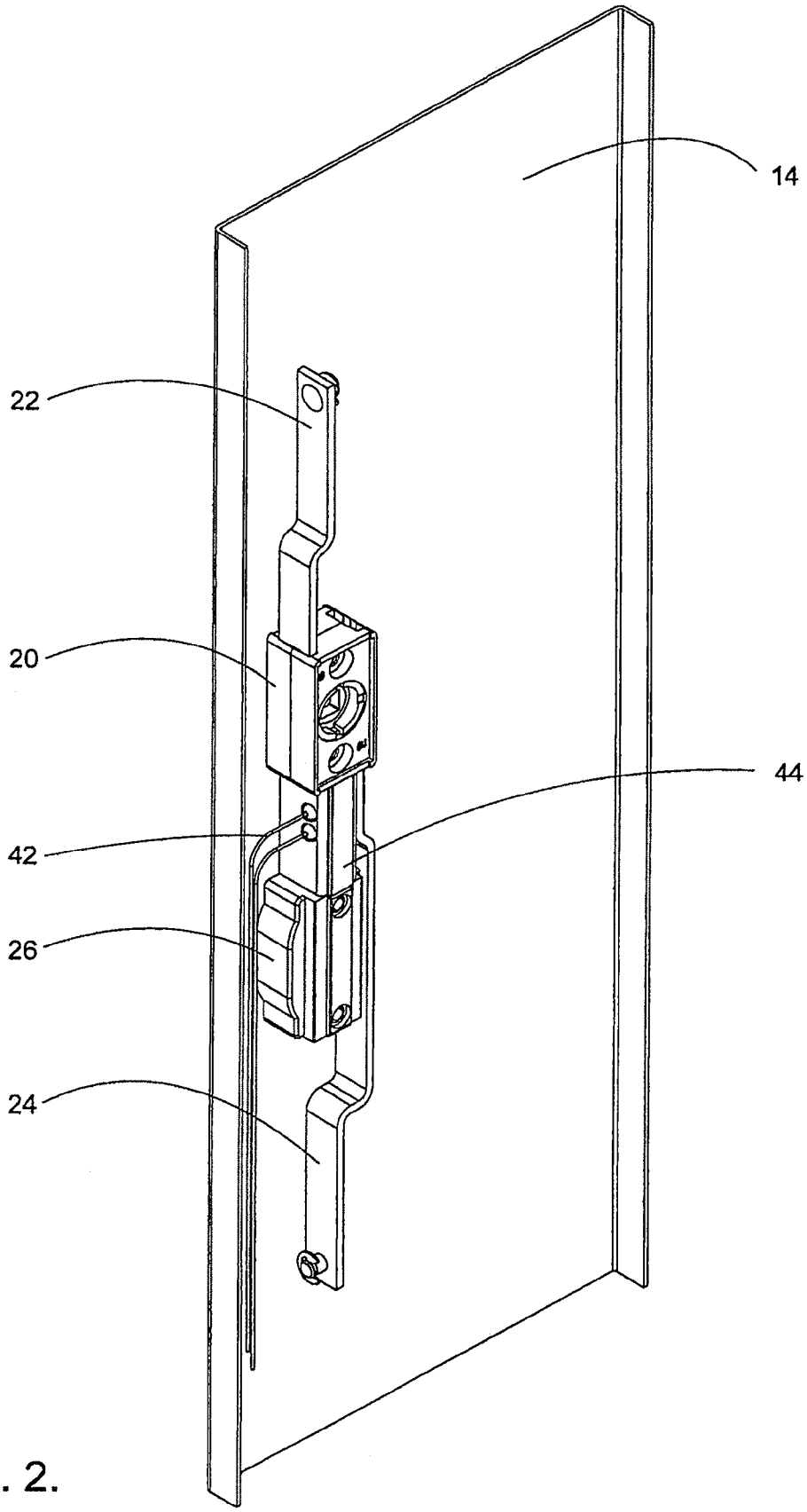
FIG. 2 a rear view of the door leaf of the cabinet arrangement according to FIG. 1 illustrating the invention in connection with a bar lock.

FIG. 2 shows a locking device which in the embodiment form not shown in

Figure 3:
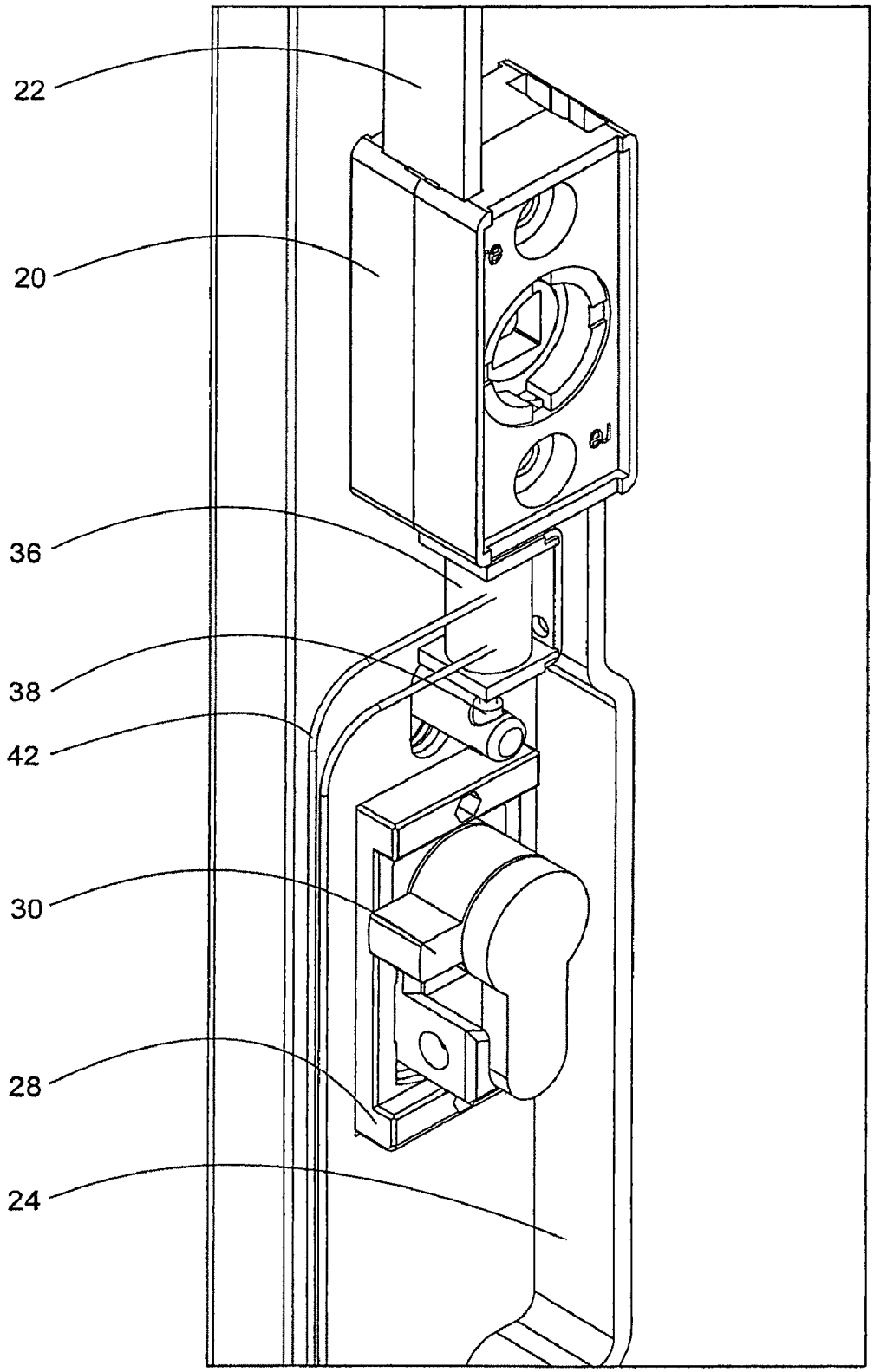
FIG. 3 an alternative embodiment form with the cover in the blocked position in a view similar to that shown in FIG. 2.

FIG. 2 comprises a cylinder lock with a cam 30 (see FIG. 3). It can also be seen from FIG. 3 that the cam 30 extends into a trough shoulder 28 so that the swivel lever can no longer be folded out, i.e., the swivel lever is locked.

In the embodiment form shown here, the cover 18 can be swiveled away (see FIG. 6) out of the covering position around a shaft 32 extending perpendicular to the door leaf plane. In so doing, a shaft piece 34 rotates. If this rotating movement is prevented, the cover cap 26 can no longer be swiveled around the shaft 32 and is blocked, for example, in the covering position as is shown in FIG. 1.

Figure 12A:
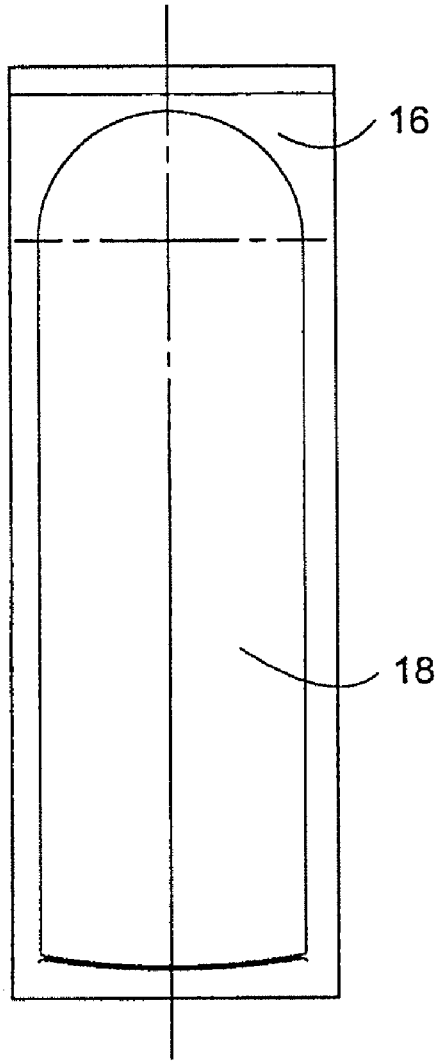
FIG. 12A a top view.
Figure 12B:
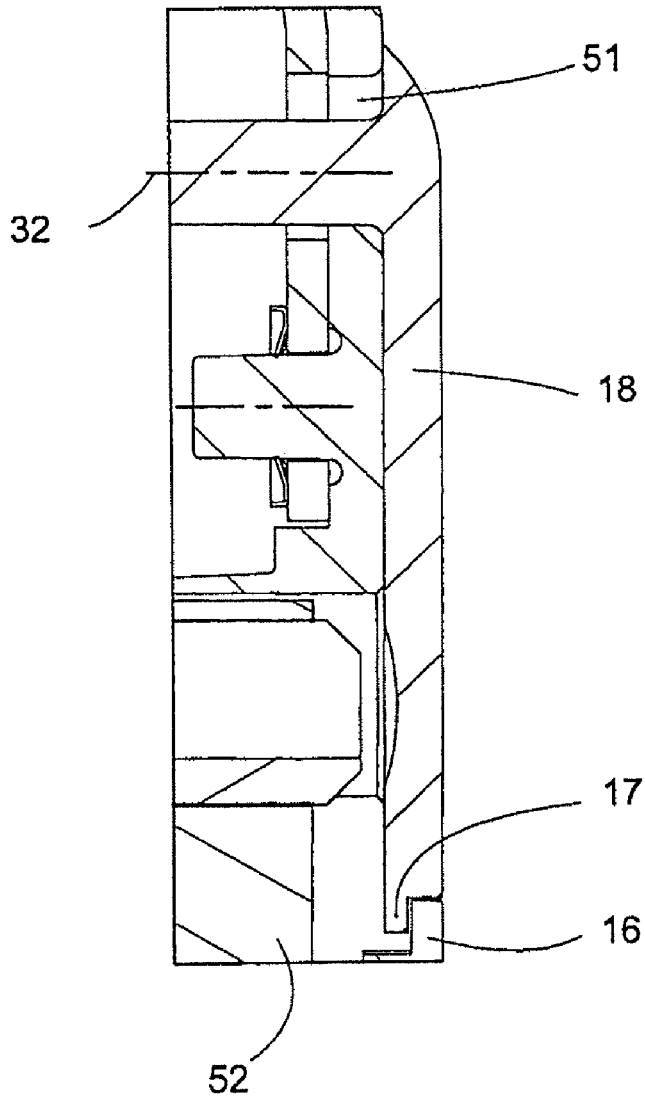
FIG. 12B an axial sectional view through the area of the cover, with the cover closed.
Figure 13A:
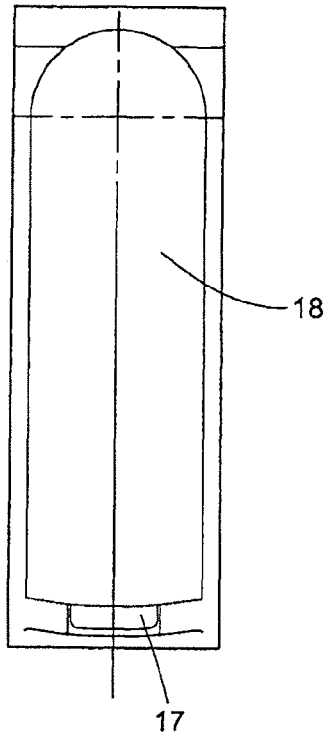
FIGS. 13A and 13B a top view and an axial sectional view similar to FIGS. 12A and 12B, but in the releasing position ready to open.
Figure 13B:
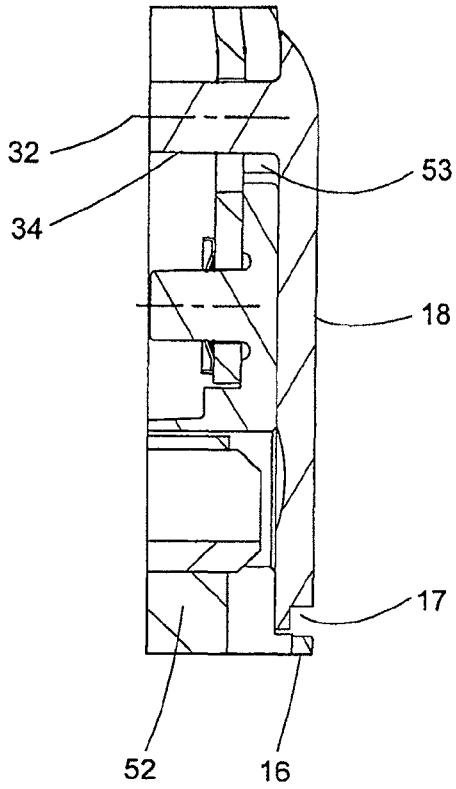
Figure 13C:
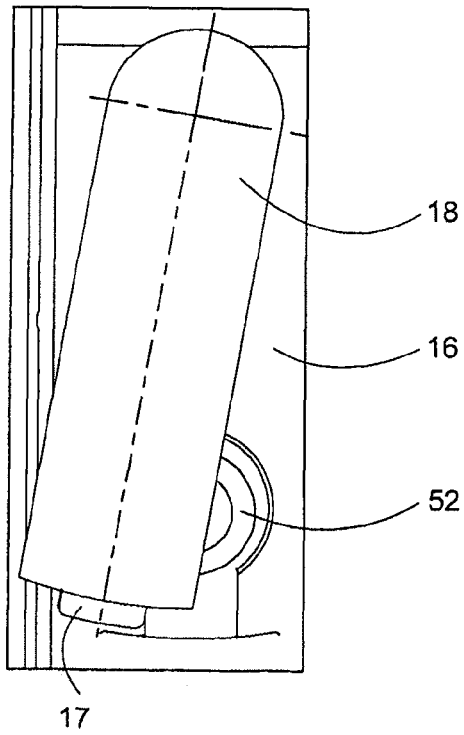
FIG. 13C a top view of the swivel lever with the cover in a position in which it is already partially swiveled away from the cylinder lock.

FIG. 12A shows a top view and FIG. 12B shows an axial sectional view through the area of the cover 18 with the cover 18 closed; FIGS. 13A and 13B show a top view and an axial sectional view, respectively, similar to FIGS. 12A and 12B but in the ready-to-open releasing position; and FIG. 13C shows a top view of the swivel lever 16 with the cover 18 in the position in which it is already partially swiveled away from the cylinder lock 52.

The swivel lever 16, which can be locked by the cylinder lock 52 in the position in which it is folded into the trough 48, is characterized in that the cover 18, together with its shaft 32 extending perpendicular to the longitudinal extension of the swivel lever 16, is displaceable along the longitudinal extension of the lever 16 from a first position (holding position), shown in FIGS. 12A and 12B, to a second position (releasing position), shown in FIGS. 13A and 13B, wherein the cover 18 is held at its end 17 remote of its shaft 32 by the swivel lever 16 in the holding position.

The swivel lever 16 has a bore hole 50 in the form of an elongated hole for the shaft 32 of the cover 18 such that the cover 18 can be displaced between the holding position and releasing position.

Figure 9:
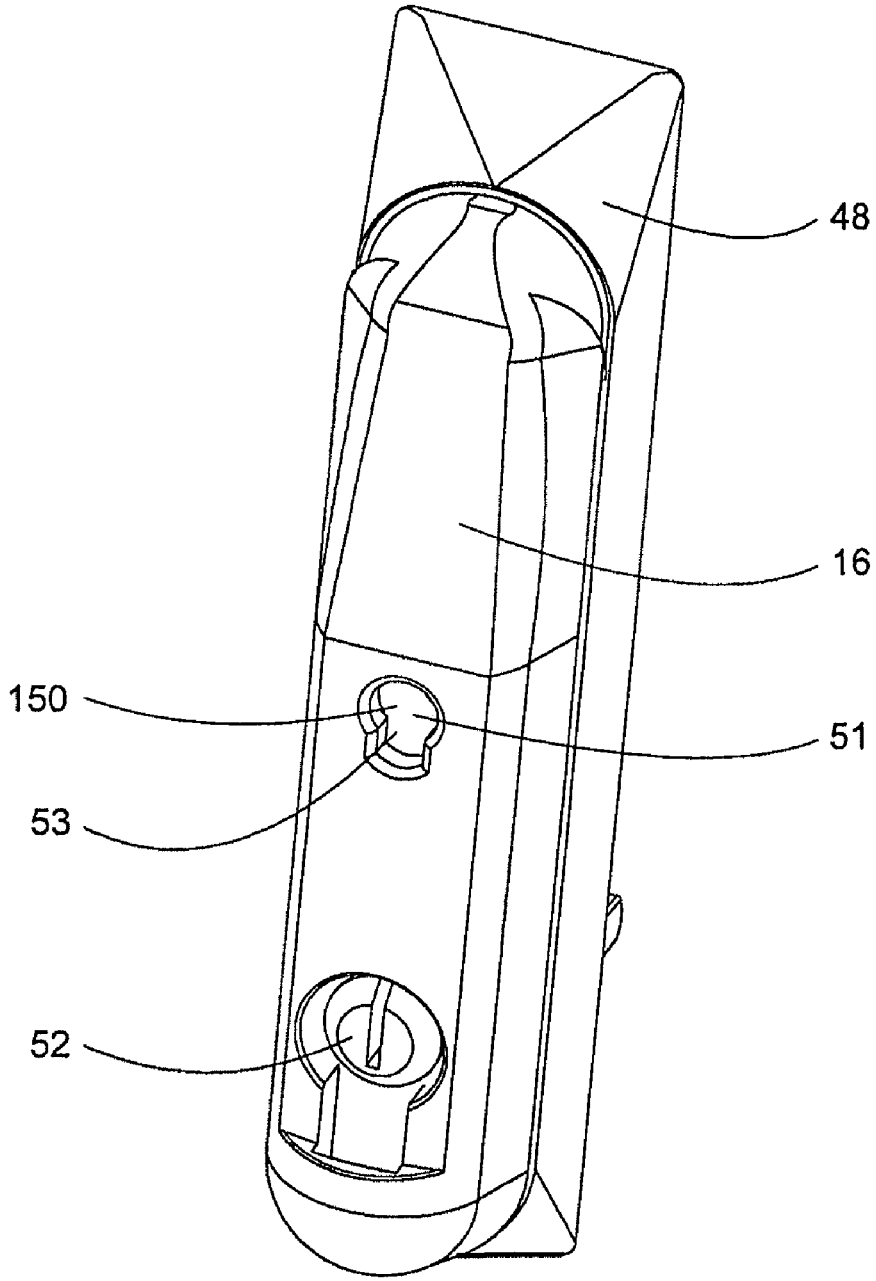
FIG. 9 the trough with folded in swivel lever, but with the cover removed.
Figure 10:
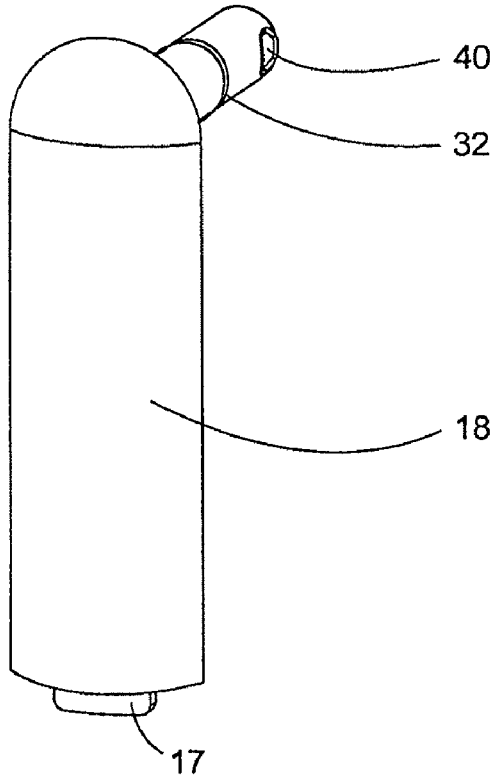
FIG. 10 a perspective rear view of the cover with shaft.
Figure 11:
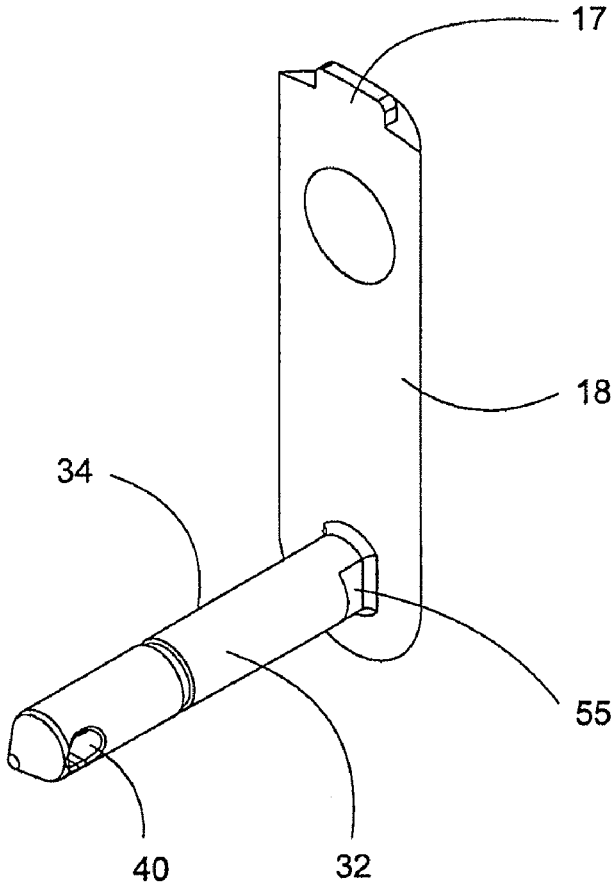
FIG. 11 a perspective front view.

According to FIG. 9, the elongated hole 150 has a keyhole shape and is formed by a circular area 51 for the shaft 32 of the cover 18 in the releasing position and by an adjoining area 53 which narrows in direction of the free, nose-shaped end 17 of the swivel lever 18 for the shaft 32 of the cover 18 in the holding position, wherein the cross section of the shaft 32 of the cover 18 deviates from the circular shape at the level of the elongated hole 150 and forms two flattened portions 55 which are parallel to one another and which allow the shaft 32 to be inserted, but not rotated, in the narrowed area 53 of the elongated hole 150 when the cover 18 is oriented to the swivel lever 16.

The electronic blocking of the cover 18 is achieved by means of a pin 38 shown in FIG. 2. This pin 38 penetrates into a bore hole 40 at the end of the shaft 34 so that the shaft can no longer be rotated (and can also not be displaced, as the case maybe), i.e., when the pin is located in the position shown in FIG. 3, the cover 18 lies in the covering position according to FIG. 1 and can also not be rotated out of this position. As soon as the solenoid 36 is supplied with current via the connection lines 42 (or, alternatively, when the current is interrupted), the pin 38 is pulled out of the bore hole 40, and the cover 18 is accordingly released so that it can be pushed into the releasing position and rotated out of the covering position, for example, into the position shown in FIG. 6.

The inward and outward movement of the pin 38 when the solenoid 36 is actuated can be carried out against spring force in such a way that the rotating movement and, e.g., the movement of the pin 38 into the bore hole 40 is carried out automatically when rotating into the covering position.

The solenoid 36 and the shaft piece 34 with the bore hole 40 can be enclosed by a housing (see reference number 44 in FIG. 2).

An electronic device 46 can serve to trigger the current (or, alternatively to interrupt the current) in the solenoid and accordingly to release the cover 18. This electronic device 46 can be arranged at a suitable location and remote of the locking lever 16. In the present case, it is arranged next to the lock 16 at the door frame of the frame 12. The electronic device 46 can comprise sensor devices which, for example, detect a fingerprint or the color of the iris, or a chip card or a transponder device which identifies a person.

Figure 4:
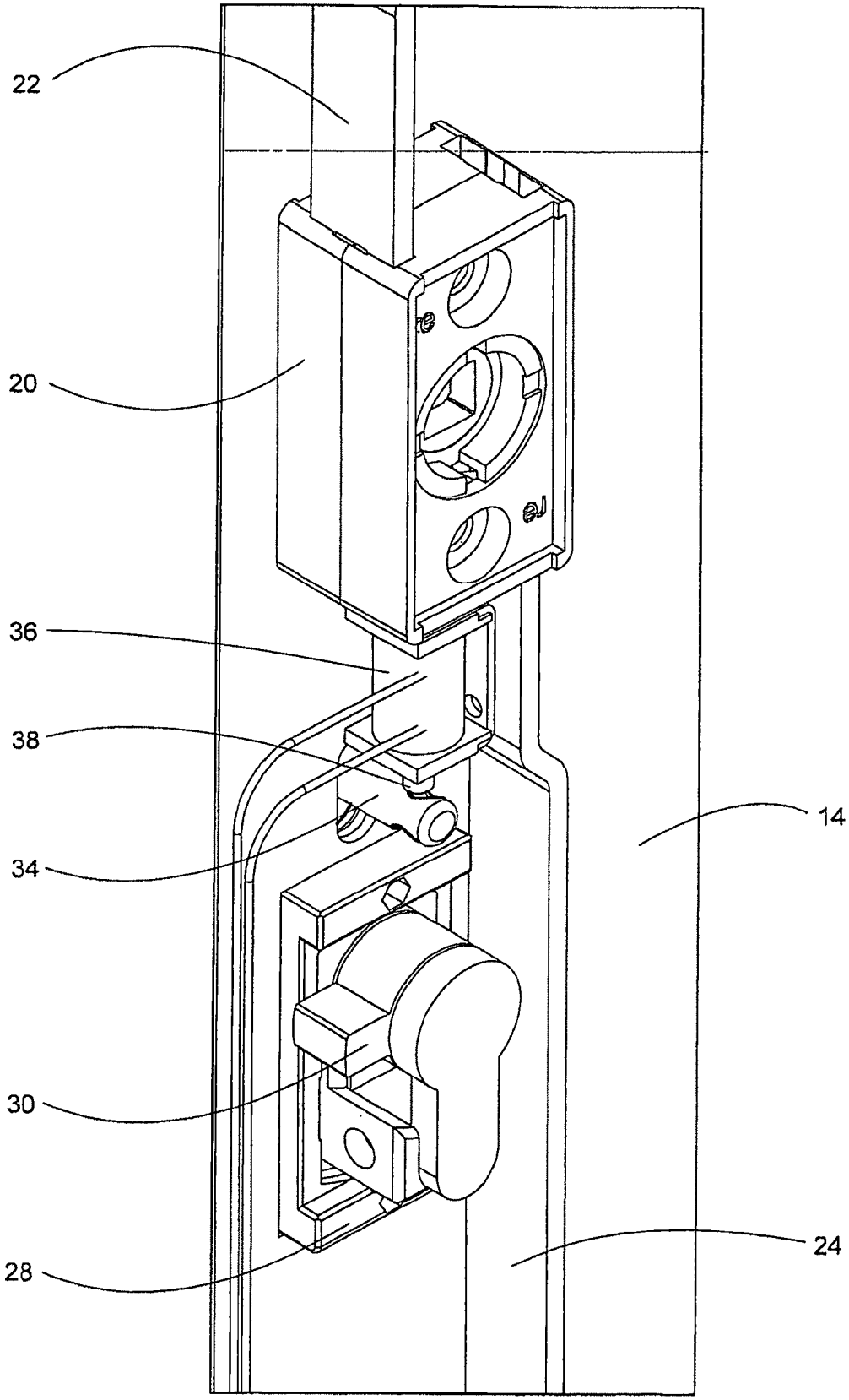
FIG. 4 the embodiment form from FIG. 3, but in the released position.

FIG. 3 shows the state with the pin 38 blocking the shaft piece 34, while FIG. 4 shows the state in which the pin is lifted and the shaft piece is released.

Figure 6:
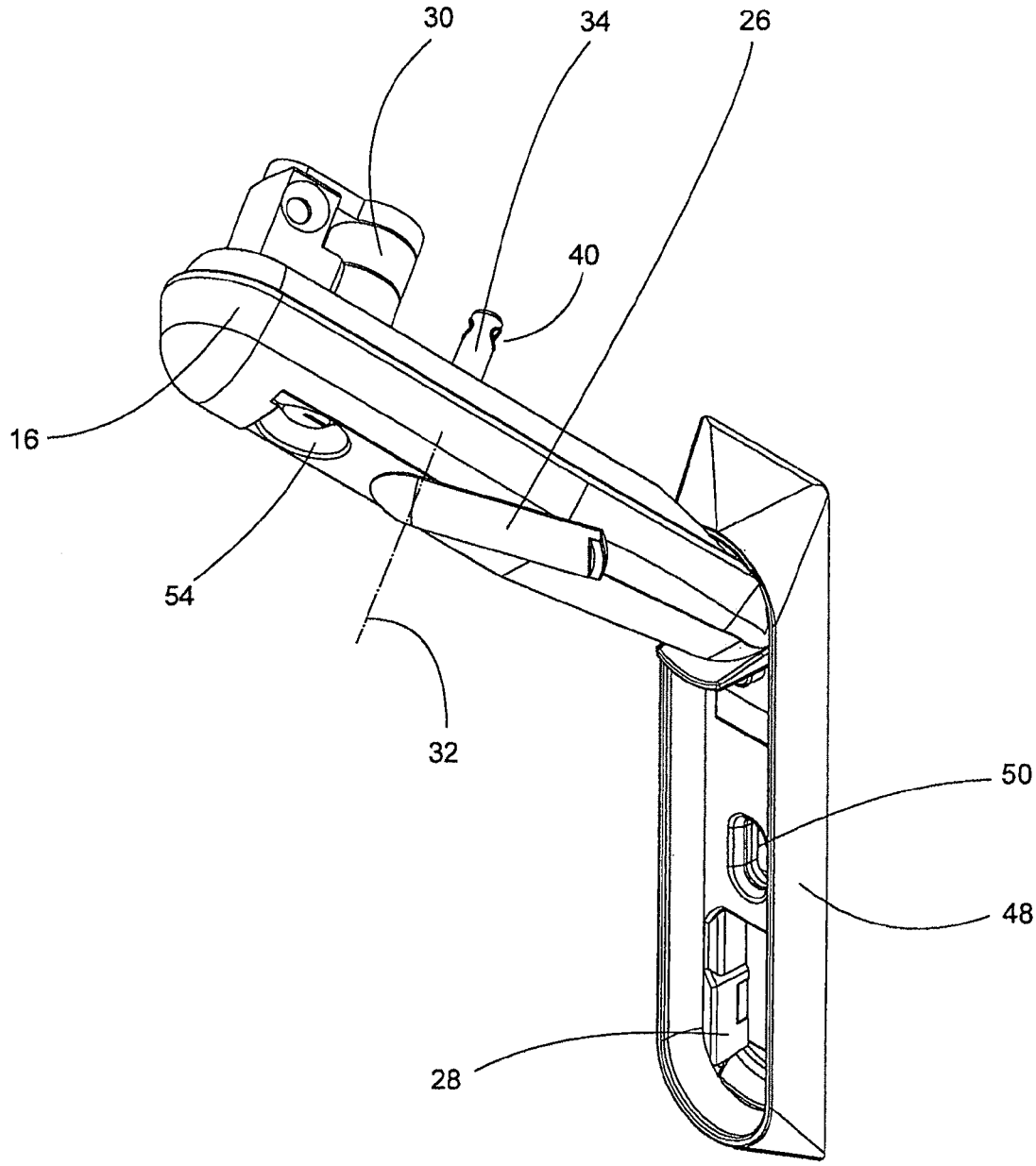
FIG. 6 the closure from FIG. 1, but with the cover swiveled away and with the hand lever swiveled.
Figure 7:
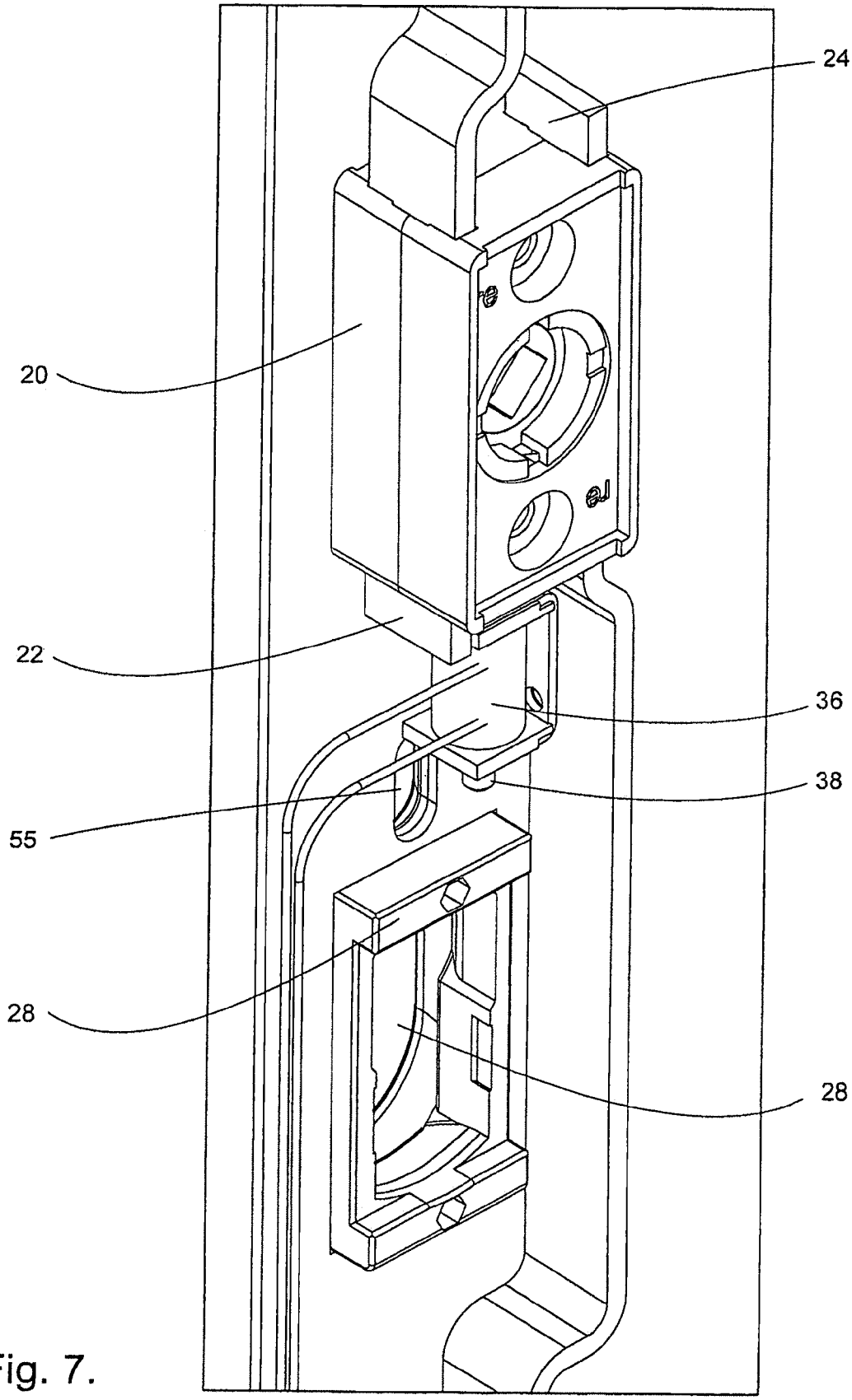
FIG. 7 another embodiment form.
Figure 8:
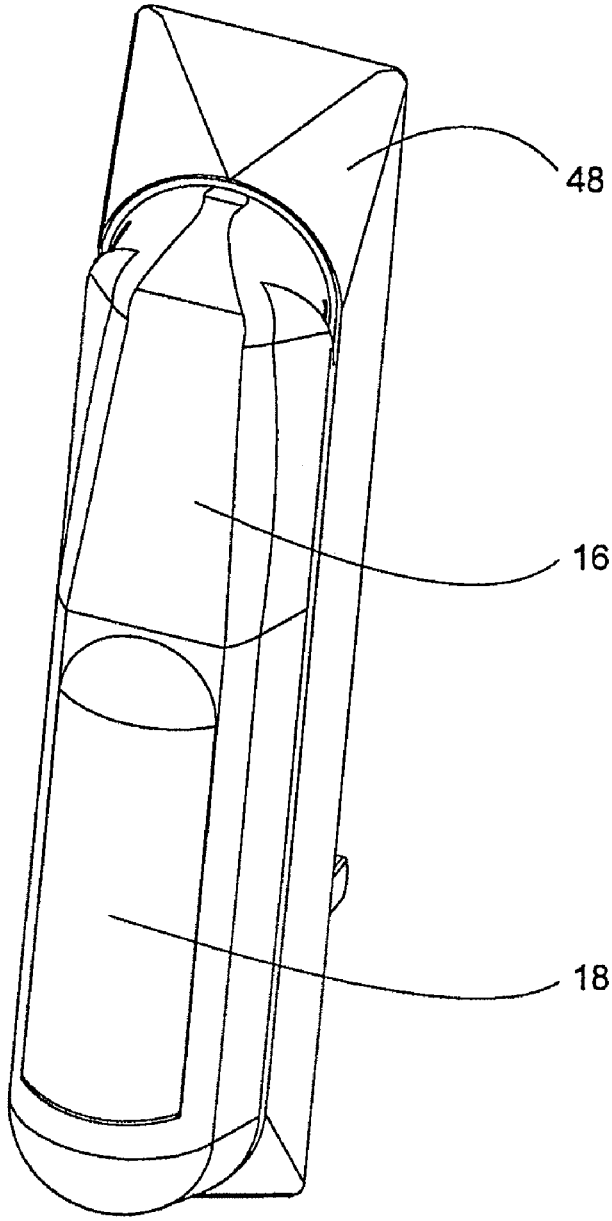
FIG. 8 a perspective view of the swivel lever folded into the trough with closed, locked cylinder cover.

FIG. 6 clearly shows the trough 48 with a bore hole 50 which extends through the opening 50 receiving the shaft piece 34. The trough has the shoulder 28, which extends through the corresponding rectangular opening of the door and is held by the latter, and a second fastening position by means of the lock case.

Figure 5:
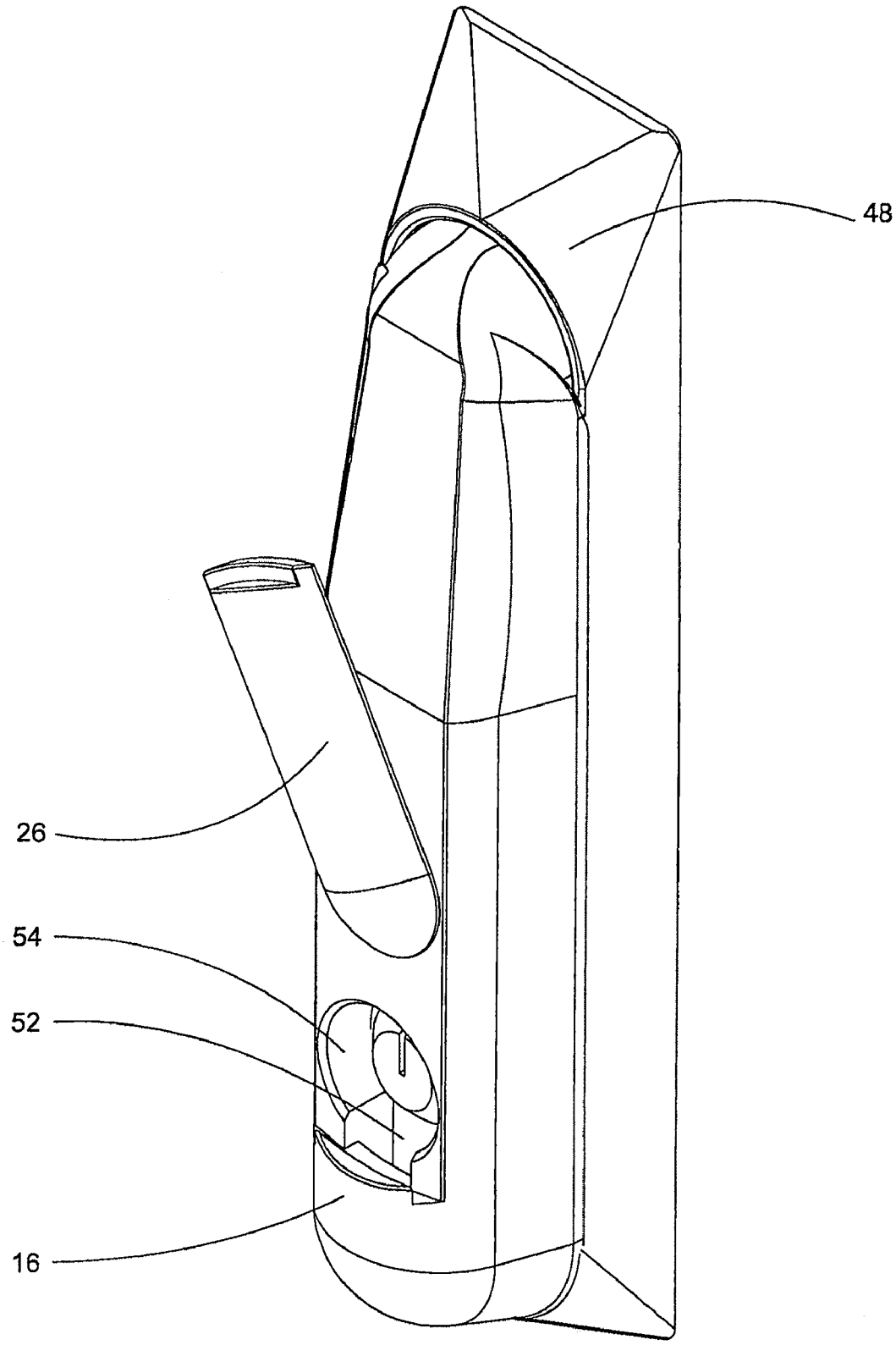
FIG. 5 the closure from FIG. 1 with the cover swiveled away.

FIG. 5 shows a profile cylinder 52. It is clearly shown that the swivel lever actuating device can serve not only as a drive for a bar lock, but also for other types of locks, for example, a rotary sash-type fastener. As such, the embodiment form shown in the drawing is only an example. It is likewise clear that the lever can be locked in the trough in some other way instead of by the cylinder, for example, by a key lock, not shown. In every case, it is important that a cover 18 or 26 is provided for the access to the unlocking of the hand lever 16.

The element, such as the pin 38, blocking the shaft piece can also take other forms to which the shaft piece would then be adapted. For example, the pin could have a rectangular or square cross section, or could have the shape of a fork which engages the shaft piece, in this case, e.g., a rectangular shaft piece, so as to be fixed with respect to rotation relative to it.

The assembly could be configured in such a way that the blocking of the cover is canceled in emergency situations such as a power outage, e.g., in that the pin or the fork is retracted by spring force and the cover is released so that the swivel lever can be unlocked with the appropriate key and folded out so that, for example, a bar lock can be unlocked by turning the swivel lever and, e.g., the cabinet can be opened. Therefore, in case of a power outage, the double safeguard becomes a single safeguard which is sufficient for general protection in most cases of application.

Industrial Applicability

The invention is industrially applicable in switch cabinet construction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

REFERENCE NUMBERS

10 switch cabinet
12 frame
14 door
16 swivel lever actuating device
17 end
18 cover
20 lock case
22 locking bar
24 locking bar
26 protective cap
28 trough shoulder
30 cam
32 shaft
34 shaft piece
36 solenoid, electromagnetic drive
38 pin
40 bore hole
42 connection line
44 housing
46 electronic device, sensor device
48 trough
50, 150 opening
51 circular area
52 profile cylinder
53 narrowed area
54 access opening
55 flattened portions

The invention claimed is:

1. A lockable swivel lever which can be locked in a trough in a swiveled in position and which comprises:

a locking device which is accommodated in the swivel lever and which can be unlocked by way of an access opening in the swivel lever, wherein the access opening can be made inaccessible by means of a cover;

wherein the cover can be blocked electromechanically, in its covering position;

wherein the cover can be swiveled out of the covering position around a shaft extending perpendicular to an extension of the swivel lever;

wherein the cover, together with its shaft is displaceable along the extension of the swivel lever from a first position to a second position;

wherein the cover is held at its end remote of its shaft by the swivel lever in a holding position;

wherein the swivel lever has a bore hole in the form of an elongated hole for the shaft of the cover such that the cover can be displaced between the holding position and a releasing position;

wherein the elongated hole has a keyhole shape comprising:

a circular area for the shaft of the cover in the releasing position; and an adjoining area which narrows in direction of a free end of the swivel lever for the shaft of the cover in the holding position; and wherein the cross section of the shaft of the cover deviates from the circular area of the keyhole shape at the level of the elongated hole and forms two flattened portions which are parallel to one another and which allow the shaft to be inserted, but not rotated, in the narrowed adjoining area of the elongated hole when the cover is oriented to the swivel lever.

2. The lockable swivel lever according to claim 1;

wherein the cover can be blocked by means of a displaceably supported pin or slide.

3. The lockable swivel lever according to claim 1;

wherein the cover can be moved against spring force or against gravitational force out of a blocking position or out of the releasing position.

4. The lockable swivel lever according to claim 1;

wherein the cover can be blocked or released by means of a solenoid-actuated device.

5. The lockable swivel lever according to claim 1;

wherein the cover can be blocked or released by means of a motor-actuated device.

6. The lockable swivel lever according to claim 1;

wherein the cover is provided for a lock which can be actuated by inserting a key.

7. The lockable swivel lever according claim 1;

wherein the cover is provided for a profile cylinder.

8. The lockable swivel lever according to claim 1;

wherein an electromechanical drive is accommodated in the a lock case of a bar lock.

9. The lockable swivel lever according to claim 1;

wherein an electromechanical drive is arranged or integrated in the area of the swivel lever.

10. The lockable swivel lever according to claim 1;

wherein an electromechanical drive can be controlled by a sensor device.

11. The lockable swivel lever according to claim 1;

wherein an electromechanical drive is part of a monitoring network.

* * * * *